US008719962B1

(12) United States Patent
Huff

(10) Patent No.: US 8,719,962 B1
(45) Date of Patent: May 13, 2014

(54) METHOD OF CREATING A THREE-DIMENSIONAL IMAGE ON A GARMENT

(76) Inventor: Brady Huff, Tarzana, CA (US)

( * ) Notice: Subject to any disclaimer, the term of this patent is extended or adjusted under 35 U.S.C. 154(b) by 88 days.

(21) Appl. No.: 13/314,131

(22) Filed: Dec. 7, 2011

(51) Int. Cl.
*A41D 13/00* (2006.01)

(52) U.S. Cl.
USPC ..... 2/69

(58) Field of Classification Search
USPC ..... 2/69, 115, 74, 243.1, 77, 133, 244, 246, 2/249, 250; 428/195.1; 156/230, 234
See application file for complete search history.

(56) References Cited

U.S. PATENT DOCUMENTS

| | | | |
|---|---|---|---|
| 4,466,860 | A | 8/1984 | Aggio |
| 6,875,395 | B2 | 4/2005 | Kisha |
| 7,435,264 | B2 | 10/2008 | Kiff |
| 7,947,357 | B2 | 5/2011 | Bauer et al. |
| 2009/0025123 | A1 | 1/2009 | Weedlun |
| 2009/0061173 | A1 | 3/2009 | Liao |
| 2011/0008618 | A1 | 1/2011 | Weedlun |

FOREIGN PATENT DOCUMENTS

| | | |
|---|---|---|
| EP | 1905888 | 4/2008 |
| JP | 2006219809 | 8/2006 |
| WO | WO2007419710 | 5/2007 |
| WO | WO2007072587 | 6/2007 |

*Primary Examiner* — Tejash Patel
(74) *Attorney, Agent, or Firm* — Thomas I. Rozsa

(57) ABSTRACT

Creating a garment which has a three-dimensional image on the garment created by removing a portion of the garment to create an image on an outer garment, the process being chemical etching, and thereafter a second garment has an image printed on the exact same location as on the first garment to match the see-through image and the second garment is affixed behind the first garment to create a three-dimensional image for the see-through image portion of the first garment, whether it matches up or complements the outer layer to give a three-dimensional look and feel.

9 Claims, 5 Drawing Sheets

METHOD OF CREATING A THREE-DIMENSIONAL IMAGE ON A GARMENT

BACKGROUND OF THE INVENTION

1. Field of the Invention

The present invention relates to the field of chemical etching of images on garments and supplementing the image through unique garment image creation practices.

2. Description of the Prior Art

The following eleven patents and publication patent applications are relevant to the field of the present invention.

1. U.S. Pat. No. 4,466,860 issued to Giordano Aggio on Aug. 21, 1984 for "Method For Producing Etched Patterns on Textile Fabrics" (hereafter the "Aggio Patent");

2. U.S. Pat. No. 6,875,395 issued to Brent J. Kisha et al. on Apr. 5, 2005 for "Method of Making An Applique" (hereafter the "Kisha Patent");

3. U.S. Pat. No. 7,435,264 issued to Mark Kiff on Oct. 14, 2008 for "Sculptured And Etched Textile Having Shade Contrast Corresponding To Surface Etched Regions" (hereafter the "Kiff Patent");

4. United States Published Patent Application No. 2009/0025123 to Paul Weedlun et al. on Jan. 29, 2009 for "Digital Printed Applique Emblem" (hereafter the "'0025123 Weedlun Published Patent Application");

5. United States Published Patent Application No. 2009/0061173 to I-Hung Liao et al. on Mar. 5, 2009 for "Manufacturing Method of Fabrics with Colored Stereoscopic Patterns and Fabrics Manufactured Therefrom" (hereafter the "Liao Published Patent Application");

6. United States Published Patent Application No. 2011/0008618 to Paul Weedlun on Jan. 13, 2011 for "Applique Having Dual Color Effect By Laser Engraving" (hereafter the "'0008618 Weedlun Published Patent Application");

7. U.S. Pat. No. 7,947,357 issued to Walter G. Bauer et al. on May 24, 2011 for "Method For Placing Indicia On Nonwoven Material And Articles Therefrom" (hereafter the "Bauer Patent");

8. Japanese Patent No. JP2006219809 issued to Takuya Suchiro et al. on Aug. 24, 2006 for "Method for Producing Cloth On Which Three-Dimensional Pattern Is Formed" (hereafter the "Suchiro Japanese Patent");

9. Japanese Patent No. WO20070419710 issued to Masahiko Sakai et al. on May 3, 2007 for "Opal-Finished Fabric" (hereafter the "Sakai Japanese Patent");

10. Japanese Patent No. WO2007072587 issued to Hiroshi Uchibori et al. on Jun. 28, 2007 for "Process For Producing Cloth or Cloth Product" (hereafter the "Uchibori Japanese Patent");

11. European Patent No. EP 1905888 issued to Paolo Lenzi on Apr. 2, 2008 for "Printing Process on Textile Products Made of Cotton, Other Natural Cellulosic Fibers And Mixed Thereof, And Textile Products Thus Obtained" (hereafter the "Lenzi European Patent").

The Aggio Patent discloses the concept of etching a design into a garment. Specifically, the patent discloses:

> "A method of chemically etching textile fabrics having a weave of cotton fibers and polyester or nylon fibers to produce etched patterns is disclosed. According to the method, areas of the textile fabric are treated with a chemical composition which is reactive with the cotton fibers but not with the polyester or nylon fibers. The treated textile fabric is then heated to dry the chemical composition on the fabric to prevent distribution of the chemical into untreated fabric areas. Heat and pressure is then applied to the fabric to cause the chemical composition to react with and dissolve or otherwise destroy the cotton fibers. After press-heating, the treated textile fabric is washed to remove the cotton and chemical composition from the fabric, leaving the polyester or nylon fibers intact to produce the desired etched pattern. An article of manufacture having a substrate and chemical composition disposed thereon can also be positioned on the fabric. Application of heat and pressure in a heat transfer machine causes the chemical composition to destroy the cotton fibers to produce the desired etched pattern."

The Krisha Patent discloses an applique for applying a fabric pattern to an objet. The applique comprises a laminate having an outer periphery to define a first predetermined shape corresponding to the fabric pattern and has etches formed adjacent the periphery to simulate an appearance of stitching.

In one embodiment, the laminate comprises a top fabric layer and a bottom fabric layer. The periphery of the bottom fabric layer corresponds to the outer periphery of the applique. The top fabric layer is a strip heat sealed to the bottom layer adjacent the letter's outer periphery and has etches formed thereon so that the top fabric layer simulates the appearance of stitching.

In another embodiment, the laminate comprises a top fabric layer and a bottom fabric layer, wherein the top fabric layer has a second predetermined shape and is heat sealed to the bottom fabric layer. The top fabric layer is disposed inward from the outer periphery of the bottom fabric layer. The bottom fabric layer has a first predetermined shape and has etches formed thereon adjacent the outer periphery thereby simulating the appearance of stitching.

The Kiff Patent discloses a pattern for having a color contrast between portions of a garment. Specifically, the patent discloses:

> "A textile is disclosed having regions of color contrast and corresponding regions of sculptured three-dimensional surface geometry. Furthermore, one or more methods of making such a textile also are disclosed. The textile includes a first side having first regions and second regions in a predetermined pattern. The first and second regions differ in color shade values due to the etching of the textile, which has the effect of degrading or dissolving fiber material from the second regions, thereby providing a three-dimensional sculpted geometry and a color contrast between etched and non-etched areas. Screen printing is applied using an extremely strong acidic or alkali composition paste upon the textile, followed by heating. Then, a washing step and a drying step results in a product having a color shade difference between etched areas and non-etched areas having differing .DELTA.L* color shade values using L*a*b* color space measurement techniques."

This patent discloses the concept of etching the image into the garment to a chemical treatment process.

The '0025123 Weedlun Published Patent Application discloses a digital printed applique emblem process. Specifically, the published application discloses:

> "According to the present invention, the above-described and other objects are accomplished by a product and process for applying digitally printed applique indicia which is capable of being adhered to a garment or other article by a pressure sensitive or thermal activated adhesive and, when so secured, gives the appearance of a multicolored graphical design that can simulate stitched designs or layered textile embellishment. The production process for digitally printed applique emblems as described above begins with (1) a design phase by which a distinct image file is digitally created using raster imaging software (for newly generated artwork) or is derived from a pre-established design by scanning or the like. In either case the image file preferably incorporates both printed image elements (text, numbers and/or logo) as well as engraving elements and/or cutting elements (one skilled in the art should understand that separate files may be created for these separate elements. Design phase (1) is followed by (2) a separation phase in which (according to the preferred method) the cutting elements from the raster file are isolated and converted into a vector cut file(s) to optimize cutting speed; and (3) a printing phase by which the raster image file is input into a digital printer which translates the pixel color values of the raster image file to obtain the optimal color match for driving a digital printer based on the ink dye set used by that particular printer. The digital printer then precisely applies the ink droplets to a fabric substrate and thermally sets the ink (and optionally post treats to improve fastness properties)."

The Liao Published Patent Application discloses a manufacturing method of fabrics with colored stereoscopic patterns and fabrics manufactured therefrom. The published application discloses:

"The present invention relates to a manufacturing method of a fabric with colored stereoscopic patterns which comprises providing a fabric having a man-made fiber layer and a natural fiber layer; analyzing the colors of the desired patterns to be printed through color separation, providing a printing board for each color, and printing the desired colored patterns on the natural fiber layer and printing an etching agent on an area outside the colored patterns on the natural fiber layer via the printing boards; and etching the area on the natural fiber layer that is printed with the etching agent, and then removing the etched area of the natural fiber layer without etching the man-made fiber layer, so as to form the colored stereoscopic patterns woven by the natural fibers on the man-made fiber layer."

The '0008618 Weedlun Published Patent Application has the same disclosures as previously discussed with some additional disclosures. Further, referring to FIG. 3, the published application discloses:

"Upper textile layer 10 is printed with a design element (screen printing is presently preferred); upper textile layer 10 bearing the ink design element 12 on top is laminated on its underside to a base layer 20; the underside of the base layer 20 is coated with the laminating layer 30; digitally-controlled Galvanometric laser cutting and engraving."

The Bauer Patent discloses a method for placing indicia on nonwoven materials and articles therefrom. Specifically, the patent discloses a method for making an indicia on a nonwoven article constructed from a nonwoven substrate having a first surface and an opposite-facing second surface. The method includes the following steps: defining an indicia area on the article at a predetermined location; disposing a first blocking sheet on the substrate second surface so that it coincides with the indicia area; forming an indicia group by disposing a contrast sheet onto the first blocking sheet such that the first blocking sheet is between the contrast sheet and the indicia area; and melting together the substrate with the indicia group between a hammer device and an anvil bearing an indicia pattern."

The Suchiro Japanese Patent discloses a method for producing cloth on which three-dimensional pattern is formed. The patent discloses:

"PROBLEM TO BE SOLVED: To provide a method for producing a cloth on which a fine three-dimensional pattern is formed, by clearly separating a fiber discharge processed area from an unprocessed area of fiber discharge around the processed area, independently of a kind of a fiber used in the cloth, a fineness of the fiber, a fineness of yarn, a manner in which the yarn is twisted, and a procedure in which the cloth is woven or knitted.; SOLUTION: This method for producing the cloth on which the three-dimensional pattern is formed includes a process for furnishing the fiber discharge processed area of the cloth with an ink containing an alkaline fiber discharging agent by means of an inkjet system and a process for furnishing an area other than the fiber discharge processed area with an ink containing a salt of which the pH is 3.0 to 8.0 when dissolved in water by means of the inkjet system."

The Sakai Japanese Patent discloses an opal-finished fabric. The patent discloses:

"The invention provides an opal-finished fabric with a pattern having three-dimensional feelings which is rich in the expression of color in both burnt-out and non-burnt-out portions and exhibits satisfactory strength in burnt-out portions even when the fabric is a thin fabric having highly see-through burnt-out portions, that is, an opal-finished fabric which is made from two or more kinds of fibers and which is constituted of both see-through burnt-out portions formed by the removal of at least one of the fibers and non-burnt-out portions, wherein the burnt-out portions are made mainly of a nylon fiber and the non-burnt-out portions are made mainly of a colored polyester fiber and a non-colored nylon fiber. It is preferable that the non-burnt-out portions be constituted of both a layer made mainly of a polyester fiber and a layer made mainly of a nylon fiber. Further, the strechability of the fabric can be enhanced either by incorporating a polyurethane fiber into the fabric or by making the fabric by knitting in atlas or two needle stitch texture."

The Uchibori Japanese Patent discloses a process for producing cloth or cloth product. Specifically, the patent discloses:

"In a process for producing a cloth or cloth product decorated by one or two or more fixed decorative cloth pieces, there is proposed a technique that in the employment of the method of fixing to a cloth a decorative cloth consisting of another type of cloth and thereafter conducting cutting of the decorative cloth into decorative cloth pieces of given pattern, not only reduces working labor and time but also realizes beautifully cutting into decorative cloth pieces. There are carried out the steps of joining by adhesive or sewing decorative cloth (12) larger than decorative cloth pieces (12a 12a) to cloth or cloth product constituting decoration object cloth (11) at parts of the decoration object cloth (11) for fixing of the decorative cloth pieces (12a 12a) so that their texture directions are approximately orthogonal to each other; applying etchant (14) capable of etching the decorative cloth (12) to the decorative cloth (12) along the peripheral configuration (L) of the decorative cloth pieces (12a 12a) outside the same; and removing parts of decorative cloth pieces (12a) having the etchant (14) applied thereto."

The European Patent discloses a printing process on textile products made of cotton, other natural cellulosic fibers and mixed thereof, and textile products thus obtained. The patent discloses:

"The process according to the invention consists in applying a printing paste containing high concentrations of strong alkali and moisture conditioning agents on a substrate in cotton or other natural cellulosic fibers and mixed thereof. The paste is applied through a printing matrix on which there is formed a certain pattern, and the substrate immediately undergoes a drying step at medium-low temperature and a steaming step, whereby the printing pattern becomes reproduced on the textile substrate by mercerized areas (due to the strong alkali) and non mercerized areas separated by well defined and clear borders."

SUMMARY OF THE INVENTION

The present invention is a process to create a three-dimensional image onto a garment such as a shirt. The process involves etching out an image and then there is a portion of the fabric that has now been removed which is An etched out image. The part of the fabric that remains and has been uncut is referred to as the positive. The part of the fabric that has been etched out and effectively has an image on it is called a negative. The key innovation of the present invention is what is affixed to the back of the garment behind the etched image. A printing process is performed on a full second garment such as a shirt. Essentially, it is a full shirt but the uniqueness of the present invention is printing the exact same image on the second shirt which will shine through the exact same image location which has been chemically etched out of the outer shirt so that the exact same image on the interior shirt will shine through the see-through etched out image on the outer shirt. The image on the second or inner shirt is printed at the exact same location where the identical image has been etched out of the outer or front shirt. The two garments are then aligned and tacked near the shoulder and tacked at the underarm. Therefore, the second shirt is fairly loose against the first shirt but it is affixed firm enough away that it can be worn and washed and it is not going to come apart.

The preferred method of etching is chemical etching where a silkscreen with chemicals containing the image is run over the garment so that the image is chemically etched into the garment. Preferably, the garment has sections made of cotton into which the image can be etched. The garment also has chemical resistant sections such as being made of polyester so that the image is not etched into the polyester portion of the garment.

Alternatively, the image or images printed on the interior or second garment does not have to be an exact match to the etched out image, but instead is a complementary image which has a contrasting color or pattern, but is printed at the exact same location as the etched out image on the front garment.

The present invention technique as described above is most preferably applied to a tank top, t-shirt or baseball shirts which is known as raglan. The present invention process can be used on both men's and women's shirts and other garments. The process can be used on both men's and women's shirts. The technique is also applied to a shirt known as a henley shirt which is a t-shirt that has buttons.

It is therefore an object of the present invention to provide a garment such as a tank top, t-shirt, baseball shirt, or henley shirt which has a three-dimensional image on the garment created by removing a portion of the garment to create an image on an outer or front garment, the process being etching such as chemical etching, and thereafter to provide a three-dimensional image on the outer garment by having an image printed on a second garment at that exact same location where the image was etched out of the front garment and affixing the second garment to the first garment so that the printed image shines through the see-through etched image on the first garment to provide a unique three-dimensional visual effect. The printed image can be an exact duplicate of the etched out image or can be a complementary image having a complementary color or pattern to provide the three dimensional visual effect.

It is also within the spirit and scope of the present invention to have a multiplicity of spaced apart images chemically etched into the outer garment and printed images on the interior garment, the etched and printed images being the same or different and the printed images being the same or different. It is key for the printed image or images on the interior garment to be at the same location as the etched out image or images on th front garment.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
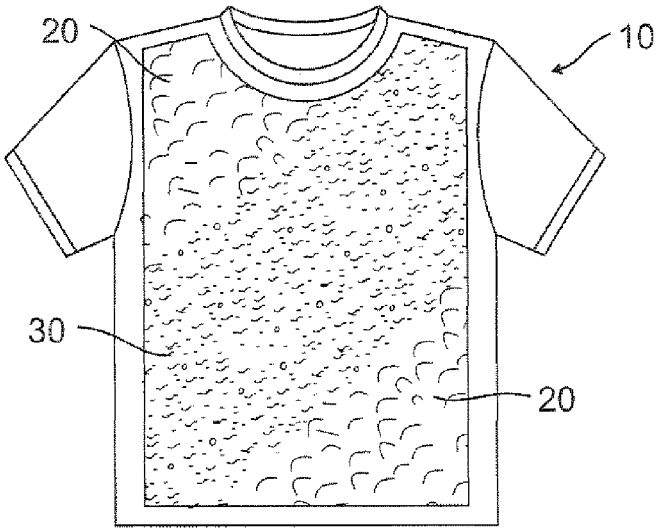
FIG. 1 is a front perspective view of a first shirt which has polyester on a portion of the shirt and cotton on another portion of the shirt.
Figure 2:
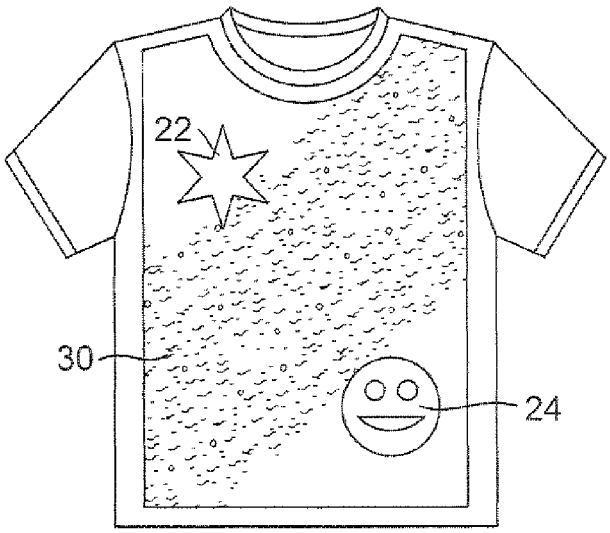
FIG. 2 is a front perspective view of a shirt of FIG. 1 which has polyester on a portion of the shirt and cotton on another portion of the shirt, where two different images have been etched into the cotton portion of the shirt.
Figure 3:
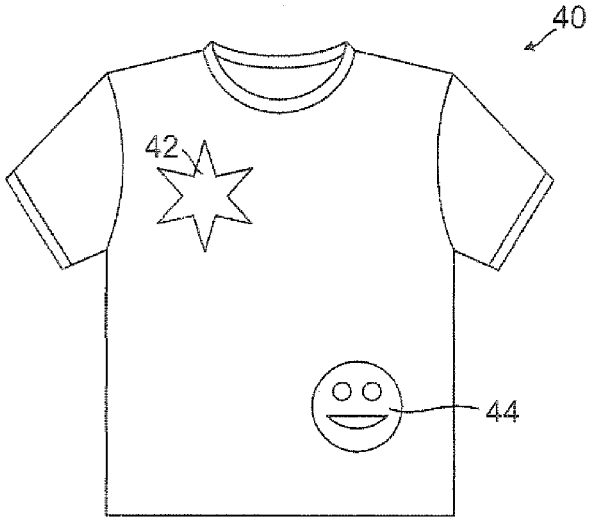
FIG. 3 is a front perspective view of a second shirt which has printed thereon the exact same images etched into the first shirt illustrated in FIG. 1, the exact same images printed at the exact same location as the images etched into the first shirt.
Figure 4:
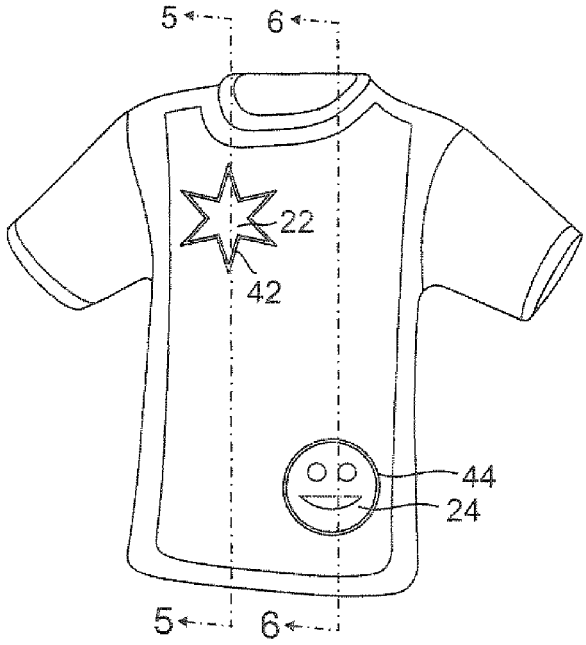
FIG. 4 is a side perspective view of the second shirt of FIG. 3 affixed onto the first shirt of FIG. 2 with the respective printed images on the second shirt being identical to the respective etched out images on the first shirt, the respective identical printed images positioned at the exact same location as the respective etched out images to provide a three dimensional appearance to the etched out images on the front shirt.
Figure 5:
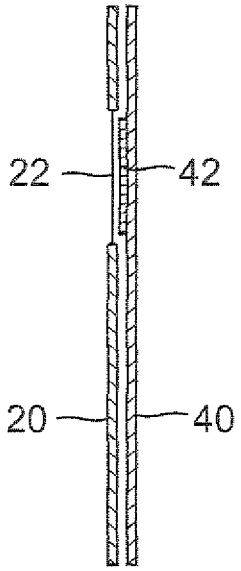
FIG. 5 is a cross-sectional view taken along line 5-5 of FIG. 4.
Figure 6:
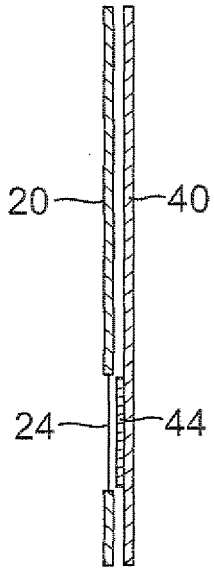
FIG. 6 is a cross-sectional view taken along line 6-6 of FIG. 4.
Figure 7:
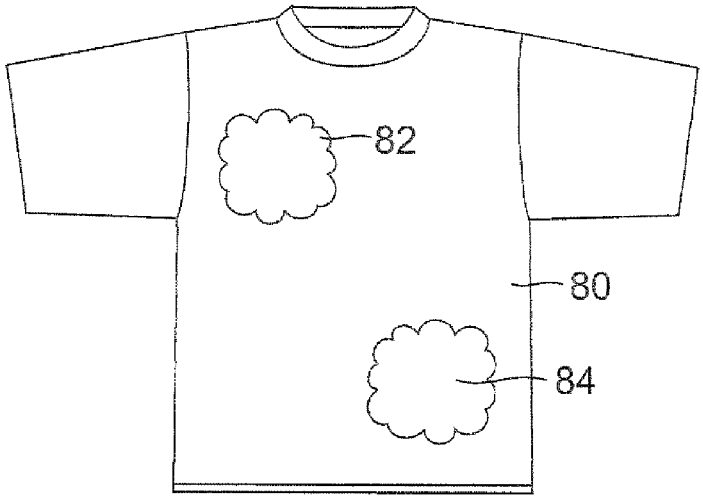
FIG. 7 is a front perspective view of a second shirt which has printed thereon complementary images which complement the images etched into the first shirt illustrated in FIG. 1, the complementary images printed at the exact same location as the images etched into the first shirt.
Figure 8:
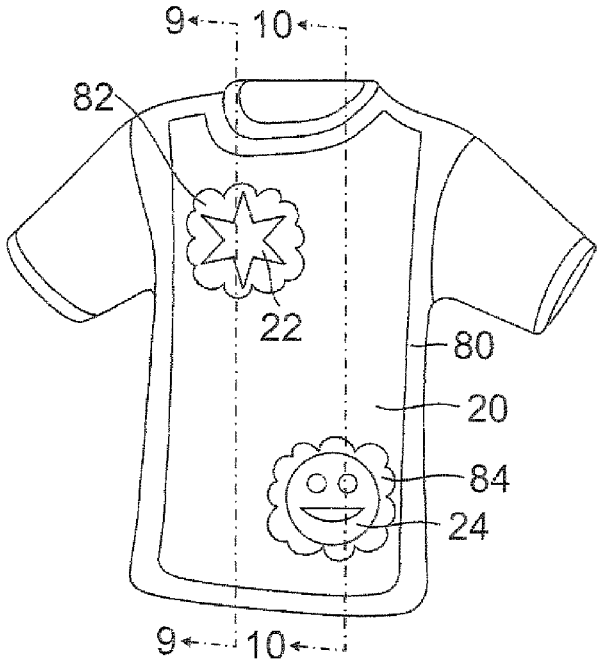
FIG. 8 is a side perspective view of the second shirt of FIG. 7 affixed onto the first shirt of FIG. 2 with the respective printed images on the second shirt being complementary to the respective etched out images on the first shirt, the respective identical printed images positioned at the exact same location as the respective etched out images to provide a three dimensional appearance to the etched out images on the front shirt.
Figure 9:
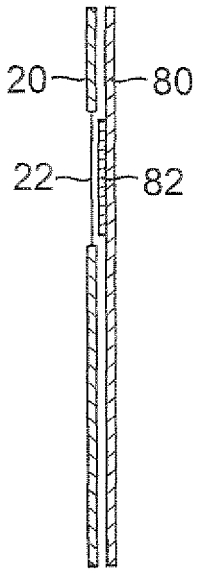
FIG. 9 is a cross-sectional view taken along line 9-9 of FIG. 8.
Figure 10:
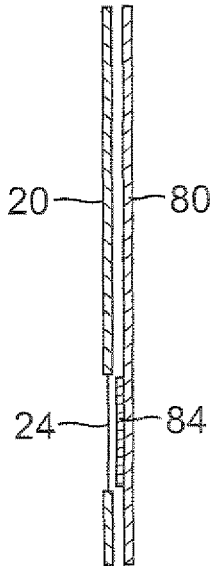
FIG. 10 is a cross-sectional view taken along line 10-10 of FIG. 8.

Referring to FIGS. 1 through 2., the present invention is a process to create a three-dimensional image onto a garment such as a shirt 10. The garment contains cotton 20 and polyester 30. The process involves chemical etching out images 22 and 24 on the cotton portion 20 and then there is a portion of the fabric 20 that has now been removed which is an etched out image. One process is to coat a silkscreen with a chemical having the image or images and running the silkscreen over the garment to chemically etch the images into the garment.

The part of the fabric that remains and has been uncut is referred to as the positive 30. The part of the fabric that has been etched out and effectively has an image on it is called a negative 20 with the etched out images numbered 22 and 24.

One key innovation of the present invention is what is applied to the back of the garment behind the chemically etched image. Referring to FIGS. 3, 4, 5 and 6, a printing process is performed on a full second garment 40 such as a shirt. Essentially, it is a full shirt 40 but the uniqueness in the present invention is printing the exact same images 42 and 44 on the second shirt 40 which will shine through the exact same images 22 and 24 at the exact location on the outer shirt 20 which has been etched or chemically etched out of the outer shirt 20 so that the exact same image on the interior shirt will shine through the see-through etched out images 22 and 24 on the outer shirt 20. The images 42 and 44 on the second or inner shirt 40 is printed at the exact same location where the identical image 22 and 24 has been respectively etched out of the outer or front shirt 20. Then the two garments are aligned and tacked near the shoulder and tacked to the underarm. Therefore, the second shirt 40 is fairly loose against the first shirt 20 but it is affixed firmly enough away that it can be worn and washed and it will not come apart.

The present invention technique as described above is most preferably applied to tank tops, t-shirts and baseball shirts which are known as raglan shirts. The technique is also applied to a shirt known as a henley shirt which is a t-shirt that has buttons.

It is therefore an object of the present invention to provide a garment such a t-shirt, baseball shirt, or henley shirt which has a three-dimensional image on the garment created by removing a portion of the garment to create an image on an outer garment, the process being etching or chemical etching, and thereafter affixing a second interior shirt with an exact same image at the exact same location as the etched out image or images on the front shirt. the two shirts affixed together.

One key innovation of the present invention is what is applied to the back of the garment behind the chemically etched image. Referring to FIGS. 3, 4, 5 and 6, a printing process is performed on a full second garment 40 such as a shirt. Essentially, it is a full shirt 40 but the uniqueness in the present invention is printing the exact same images 42 and 44 on the second shirt 40 which will shine through the exact same images 22 and 24 at the exact location on the outer shirt 20 which has been etched or chemically etched out of the outer shirt 20 so that the exact same image on the interior shirt will shine through the see-through etched out images 22 and 24 on the outer shirt 20. The images 42 and 44 on the second or inner shirt 40 is printed at the exact same location where the identical image 22 and 24 has been respectively etched out of the outer or front shirt 20. Then the two garments are aligned and tacked near the shoulder and tacked to the underarm. Therefore, the second shirt 40 is fairly loose against the first shirt 20 but it is affixed firmly enough away that it can be worn and washed and it will not come apart.

The present invention technique as described above is most preferably applied to tank tops, t-shirts and baseball shirts which are known as raglan shirts. The technique is also applied to a shirt known as a henley shirt which is a t-shirt that has buttons.

It is therefore an object of the present invention to provide a garment such a t-shirt, baseball shirt, or henley shirt which has a three-dimensional image on the garment created by removing a portion of the garment to create an image on an outer garment, the process being etching or chemical etching, and thereafter affixing a second interior shirt with an exact same image at the exact same location as the etched out image or images on the front shirt; the two shirts affixed together.

An alternative key innovation of the present invention is what is applied to the back of the garment behind the chemically etched image. Referring to FIGS. 7, 8, 9 and 10 a printing process is performed on a full second garment 80 such as a shirt. Essentially, it is a full shirt 80 but the uniqueness in the present invention is printing the a complementary image in color or pattern 82 and 84 on the second shirt 80 which will shine through the exact same images 22 and 24 at the exact location on the outer shirt 20 which has been etched or chemically etched out of the outer shirt 20 so that the complementary image on the interior shirt will shine through the see-through etched out images 22 and 24 on the outer shirt 20. The images 82 and 84 on the second or inner shirt 80 is printed at the exact same location where the identical image 22 and 24 has been respectively etched out of the outer or front shirt 20. Then the two garments are aligned and tacked near the shoulder and tacked to the underarm. Therefore, the second shirt 80 is fairly loose against the first shirt 20 but it is affixed firmly enough away that it can be worn and washed and it will not come apart.

The present invention technique as described above is most preferably applied to tank tops, t-shirts and baseball shirts which are known as raglan shirts. The technique is also applied to a shirt known as a henley shirt which is a t-shirt that has buttons.

It is therefore an object of the present invention to provide a garment such a t-shirt, baseball shirt, or henley shirt which has a three-dimensional image on the garment created by removing a portion of the garment to create an image on an outer garment, the process being etching or chemical etching, and thereafter affixing a second interior shirt with a complementary image at the exact same location as the etched out image or images on the front shirt, the two shirts affixed together.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A process to create an image onto a garment, comprising:

a. a first garment having a portion made of cotton and a portion made of polyester, the portion made of the polyester and the portion made of cotton are positioned at distinct locations of the garment;

b. creating at least one specific image into the cotton portion of the first garment from a process selected from the group consisting of etching and chemical etching so that a layer of the cotton fabric is removed to create a see-through at least one specific image and the polyester portion remains unchanged; and c. on a second garment, printing an identical at least one specific image at the exact same location as the at least one specific image on the first garment to match the at least one specific image created in the first garment and affixing the second garment directly behind the first garment so that the printed image on the second garment is exactly matched to the at least one specific image on the first garment so that the printed image from the second garment is visible through the see-through at least one specific image on the first garment to create a three-dimensional appearance of the at one specific image on the first garment.

2. The process to create and image on a garment in accordance with claim 1, further comprising:

a. garment is selected from the group consisting of men's garments and women's garments.

3. The process to create an image on a garment in accordance with claim 1, further comprising:

a. the garment is selected from the group consisting of tank tops, t-shirts, baseball shirts, raglan, and henley.

4. A process to create an image onto a garment, comprising:

a. a first garment having a portion made of cotton and a portion made of polyester, the portion made of polyester and the portion made of cotton are positioned at distinct locations of the garment;

b. creating at least one specific image into the cotton portion of the first garment from a process selected from the group consisting of etching and chemical etching so that a layer of the cotton fabric is removed to create a see-through at least one specific image and the polyester portion remains unchanged; and c. on a second garment, printing a complementary image to the etched out image at the exact same location as the at least one specific image on the first garment to match the at least one specific image created in the first garment and affixing the second garment directly behind the first garment so that the printed image on the second garment is exactly matched to the at least one specific image on the first garment so that the printed image from the second garment is visible through the see-through at least one specific image on the first garment to create a three-dimensional appearance of the at one specific image on the first garment.

5. The process to create and image on a garment in accordance with claim 4, further comprising:

a. garment is selected from the group consisting of men's garments and women's garments.

6. The process to create an image on a garment in accordance with claim 4, further comprising:

a. the garment is selected from the group consisting of tank tops, t-shirts, baseball shirts, raglan, and henley.

7. A process to create an image onto a garment, comprising:

a. a first garment having a portion in which an outer layer is capable of being removed by chemical etching, the portion made of polyester and the portion made of cotton are positioned at distinct locations of the garment;

b. creating at least one specific image into the first garment from a process selected from the group consisting of etching and chemical etching so that a layer fabric is removed from the first garment to create a see-through at least one specific image; and c. on a second garment, printing at least one image selected from the group consisting of a complementary image to the etched out image and an exact duplicate of the etched out image, the at least one printed image on the second garment printed at the exact same location as the at least one specific image on the first garment to match the at least one specific image created in the first garment and affixing the second garment directly behind the first garment so that the printed image on the second garment is exactly matched to the at least one specific image on the first garment so that the printed image from the second garment is visible through the see-through at least one specific image on the first garment to create a three-dimensional appearance of the at one specific image on the first garment.

8. The process to create and image on a garment in accordance with claim 7, further comprising:

a. garment is selected from the group consisting of men's garments and women's garments.

9. The process to create an image on a garment in accordance with claim 7, further comprising:

a. the garment is selected from the group consisting of tank tops, t-shirts, baseball shirts, raglan, and henley.

* * * * *